United States Patent [19]

Salewski

[11] Patent Number: 4,697,609

[45] Date of Patent: Oct. 6, 1987

[54] HOLDING TANK FOR WASTE FLUIDS AND PROCESS FOR DISPOSING OF WASTE FLUIDS FROM RECREATIONAL VEHICLES

[76] Inventor: Helmut Salewski, HC 1, Box 134, Olive Bridge, N.Y. 12461

[21] Appl. No.: 903,875

[22] Filed: Sep. 2, 1986

Related U.S. Application Data

[63] Continuation of Ser. No. 689,858, Jan. 9, 1985, abandoned.

[51] Int. Cl.[4] ..... F03F 5/00

[52] U.S. Cl. ..... 137/1; 137/236.1; 210/747

[58] Field of Search ..... 137/1, 205, 236, 588, 137/899; 210/519, 532.2, 533, 747; 141/1, 86, 98, 587

[56] References Cited

U.S. PATENT DOCUMENTS

| | | | |
|---|---|---|---|
| 1,651,616 | 12/1927 | Morrison | 184/1.5 |
| 2,915,081 | 12/1959 | Warren | 137/899 |
| 3,097,166 | 7/1963 | Monson | 210/261 |
| 3,221,881 | 12/1965 | Weiler et al. | 210/233 |
| 3,260,371 | 7/1966 | Wall | 210/533 |
| 3,426,903 | 2/1969 | Olecko | 210/532.2 |
| 3,433,258 | 3/1969 | Steele | 137/590 |
| 3,746,032 | 7/1973 | Wallgren | 137/205 |
| 3,819,137 | 6/1974 | Smith | 248/80 |
| 3,872,886 | 3/1975 | Shotmeyer | 137/588 |
| 3,981,323 | 9/1976 | Watson | 137/899 |
| 4,092,338 | 5/1978 | Tossey | 210/519 |
| 4,213,479 | 7/1980 | Pearson | 137/205 |
| 4,231,595 | 11/1980 | Knutsen | 137/899.3 |

*Primary Examiner*—Alan Cohan

*Attorney, Agent, or Firm*—Lowe, Price, LeBlanc, Becker & Shur

[57] ABSTRACT

An in-ground holding tank to collect sewage and grey water from recreational vehicles in areas where central sewer facilities are not feasible. The holding tank has a typical volume of 60–100 gallons and is made of non-corrosive material. The tank contains input and removal assemblies, a pressure release valve, and may contain a volume gauge.

3 Claims, 3 Drawing Figures

HOLDING TANK FOR WASTE FLUIDS AND PROCESS FOR DISPOSING OF WASTE FLUIDS FROM RECREATIONAL VEHICLES

This is a continuation of application Ser. No. 689,858, filed Jan. 9, 1985, now abandoned.

BACKGROUND OF THE INVENTION

This invention relates to holding tanks for waste fluids and in particular to a novel holding tank to collect waste fluids from recreational vehicles for use in camping areas and parks where central sewer facilities are not feasible for individual campsites.

The disposal of waste fluids, such as sewer water and other fluids used in washing, cooking, and the like (collectively termed "grey water") presents a particular problem for the owners of camping areas and parks. Typically, health department or convervation rules and regulations require the operators of camping areas and parks to make provisions for the disposal of waste fluids. While central sewer facilities are on solution, the use of such facilities is often infeasible due to the excessive expense of such systems, the difficulty of moving a recreational vehicle to a dumping station when semi-permanently stationed, or because topological concerns make the installation of central systems or large central holding tanks impossible.

Most recreational vehicles are equipped with a small holding tank for sewage but not for greywater, and at best the onboard tank capacity is very limited. Since these waste fluids cannot be discharged into the soil because of health regulations, a campsite operator, in a facility where no central sewage is available, is often asked to clean the recreational vehicle tanks. Complying with individual requests is a time-consuming chore and also creates health and sanitary concerns when the campground operator cannot provide immediate service.

The present invention solves the above-identified problems. By providing an in-ground holding tank at the recreational vehicle site (hereafter the "campsite"), the recreational vehicle's owner can discharge his own on-board holding tank into the in-ground holding tank that is the subject of this invention. The camp operator is then free to schedule service of the in-ground tanks at his convenience. Thus, the problems of complying with individual requests and the difficulties associated with the campground owner's inability to provide service on demand to individual recreational vehicle owners are eliminated. In addition, since the in-ground tank is fitted with a coupling compatable with most standardized recreational vehicle discharge portals, the danger of spillage or contamination in the discharge process is greatly reduced and the entire process is much cleaner and safer. Further, the tank is made of a durable inexpensive material, such as a non-corrosive plastic or fiberglass, and thus provides an economical method for a campground operator to comply with necessary health and conservation requirements and at the same time ease his own burden and make his campsite safer and cleaner.

The use of a holding tank to hold liquids is known in the art. It is also known to locate a holding tank for liquids, including sewage, underground, as shown in U.S. Pat. No. 3,433,258 to Steele (1969). In addition septic tank and sewage disposal systems, including systems made of materials such as fiberglass, likewise are known in the art, representative examples of which known to the applicant are: U.S. Pat. Nos. 3,426,903 to Olecko (1969); 3,260,371 to Wall (1966); 3,221,881 to Weiler, et al., (1965); and 3,097,166 to Monsen (1963). However, none of these prior art references teaches or suggests a holding tank particularly adopted for use in recreational vehicle campsites nor do they teach or suggest a process of disposing of waste fluids from recreational vehicles utilizing the novel holding tank.

SUMMARY OF THE INVENTION

The disclosed invention is a holding tank for use in disposing of waste water from recreational vehicles. The holding tank is made of non-corrosive plastic or fiberglass, and is equipped with connections to allow integral connection with the disposal portal on recreational vehicles and to allow easy cleaning of the holding tank. Also disclosed is a process for disposing of waste fluids from recreational vehicles utilizing the holding tank.

One object of this invention is to provide a holding tank for waste water from recreational vehicles and a process for disposing of waste water from recreational vehicles.

A further object of this invention is to provide a holding tank that complies with the necessary health and conservation codes regulating the disposal of waste water.

Still another object of this invention is to provide a holding tank that is made of a light, seal-tight, and inexpensive material such as non-corrosive plastic or fiberglass.

A still further object of this invention is to provide a process for the removal of waste fluids from recreational vehicles using the disclosed holding tank.

These and additional objects of the invention will become apparent as the invention is described in detail hereafter.

DESCRIPTION OF DRAWINGS

The invention will now be described in greater detail with reference to the accompanying drawings, wherein.

DETAILED DESCRIPTION OF THE INVENTION

Figure 1:
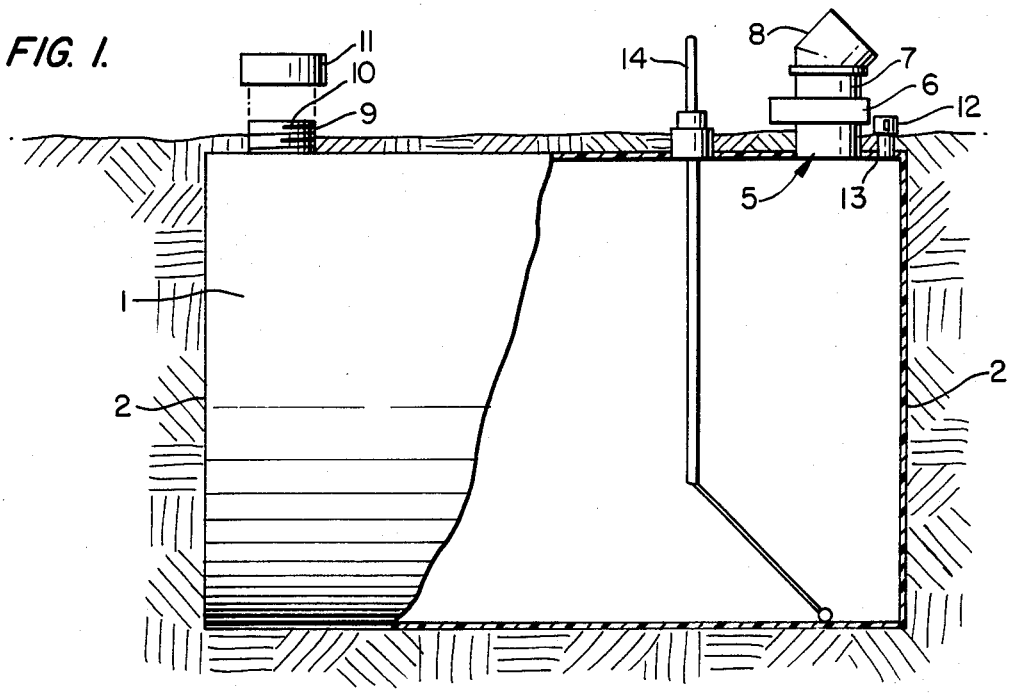
FIG. 1 is a partial cut-away side view of the holding tank.
Figure 2:
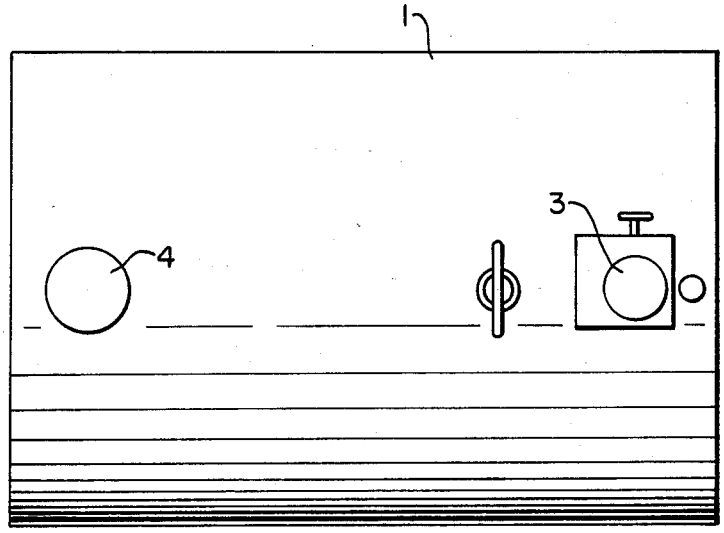
FIG. 2 depicts the holding tank in the ground as used in operation.
Figure 3:
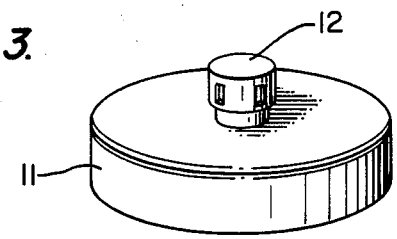
FIG. 3 depicts the vent valve located on the threaded cap.

With reference to the drawings, FIG. 1 shows the holding tank with a generally cylindrical body (1) and end walls (2) all made from ¼ inch non-corrosive plastic, fiberglass composite materials, or similar lightweight materials substantially impervious to chemical breakdown. The volume of the cylinder may vary between 30–175 gallons with the preferred volume between 60–100 gallons in a cylinder of approximately three (3) feet in length by two (2) feet in diameter. The body and walls are formed by well known methods to be impervious to leakage.

At the top of the cylindrical body (1) there are two circular apertures (3) and (4). Aperture (3) has a preferred diameter of 3 inches. An inlet pipe (5) is located in the aperture (3). A manual control valve (6) of standard construction is removably secured to the top of pipe (5) through a threaded connection or other suitable means. The control valve (6), when in the open position, allows waste fluid into the holding tank and when in the closed position seals the tank when the tank is not in use or when it is being cleaned. Affixed to the top of the control valve (6) is an adapter (7) that allows various fittings (described immediately hereafter) to be utilized. A number of well-known fittings are interchangeably utilizable to allow waste filud to be discharged from the recreational vehicle into the holding tank. One fitting (8) shown in FIG. 1 is a flexible hose connection (standard for use with most recreational vehicles) and a standard sealing adapter old in the art. The fitting (8) allows the tank to be placed in secure communication with the discharge portal of the recreational vehicle so that waste fluid may be discharged into the tank without leakage or spillage. Another fitting (not shown) allows grey water from the recreational vehicle to be disposed of into the holding tank though a smaller (approximately 1" diameter) flexible tube.

Aperture (4) has a preferred diameter of 4 inches. An outlet pipe (9) is located in aperture (4), said outlet pipe (9) having a threaded connection (10) at the top thereof. A threaded cap (11) removably secured to the outlet pipe (9) seals the holding tank and is removed to allow the tank to be pumped out.

A pressure relief valve (12) is provided at the top (13) of the tank (1). The pressure relief valve (12) is a one-way spring loaded check valve that can release gas pressure in the tank and then reseal the tank. In an alternate and equally preferred embodiment, the pressure relief valve (12) may be located at the top of cap (11). Also provided is a gauge (14) located at the top (13) of the holding tank. The volume gauge (14), which is old in the art, allows the campground operator to check the available volume in the tank by examining the analog display caliberated on the face of the gauge.

In operation the holding tank is placed in the ground next to the recreational vehicle so that the topsoil covers by approximately 1" the top (13) of the holding tank. The vent (12), and gauge (14) extend above the ground as do the input and output assemblies. When a recreational vehicle user wishes to discharge waste fluid into the holding tank, he simply attaches the appropriate fitting, such as (8), onto the recreational vehicle and opens the control valve (6). The holding tank is then in sealed communication with the storage tank in the recreational vehicle and waste fluids may be discharged into the holding tank. After the discharge is complete, the operator closes the control valve (6) resealing the holding tank. The fitting (8) may remain attached to the recreational vehicle or be decoupled from the venicle as the operator desires.

To empty the holding tank, the campground operator first places the control valve (6) in the closed position. He then removes the threaded cap (11) and places a pumping device into the holding tank through output pipe (9) and pumps the tank clean. After pumping is complete the pumping device is removed and the threaded cap (11) is replaced on the output pipe (9).

It should be understood that numerous changes in the details of construction may be made without departing from the spirit of the invention, especially as defined in the following claims.

What I claim as new and desire to secure by Letters Patent of the United States is:

1. A process of disposing of sewage and grey water from a recreational vehicle at a campsite comprising the steps of:

(a) locating underground and proximate to a parking location for a recreational vehicle a holding tank made of a material substantially impervious to chemical breakdown when placed in contact with sewage and grey water;

(b) discharging sewage and grey water into the holding tank, said discharging step comprising the steps of:

(i) connecting an inlet on the holding tank to a discharge post on the recreational vehicle so that the holding tank is in sealed communication with the recreational vehicle;

(ii) opening a control valve on the inlet to permit the discharge of the sewage and grey water from the recreational vehicle into the holding tank; and (iii) closing the control valve to seal the holding tank; and (c) removing the sewage and grey water from the holding tank at a time subsequent to their storage in the holding tank.

2. A process for removing sewage and grey water from a recreational vehicle as defined in claim 1, further comprising the step of venting excess pressure in the holding tank.

3. A process for removing sewage and grey water from a recreational vehicle as defined in claim 2, further comprising the step of measuring the amount of sewage and grey water in the holding tank.

* * * * *